United States Patent [19]

Child

[11] Patent Number: 4,540,347

[45] Date of Patent: Sep. 10, 1985

[54] GEROTOR PUMP

[75] Inventor: Robin E. Child, Wellesbourne, England

[73] Assignee: Concentric Pumps Limited, Birmingham, England

[21] Appl. No.: 693,301

[22] Filed: Jan. 23, 1985

Related U.S. Application Data

[63] Continuation of Ser. No. 452,247, Dec. 22, 1982, abandoned.

[30] Foreign Application Priority Data

Dec. 24, 1981 [GB] United Kingdom ..... 8138869

[51] Int. Cl.[3] ..... F04B 49/08; F04C 2/10; F04C 15/04

[52] U.S. Cl. ..... 417/310; 417/315; 418/32; 418/133; 418/135; 418/171; 418/188

[58] Field of Search ..... 417/310, 315; 418/32, 418/133, 135, 166, 171, 188

[56] References Cited

U.S. PATENT DOCUMENTS

| | | | |
|---|---|---|---|
| 2,380,783 | 7/1945 | Painter | 418/133 |
| 2,905,094 | 9/1959 | Gerteis | 418/32 |
| 3,034,448 | 5/1962 | Brundage | 418/135 |
| 3,165,066 | 1/1965 | Phelps et al. | 418/32 |
| 3,299,824 | 1/1967 | Gauthier | 418/135 |
| 3,343,494 | 9/1967 | Erikson et al. | 418/32 |

*Primary Examiner*—John J. Vrablik
*Attorney, Agent, or Firm*—C. O. Marshall, Jr.

[57] ABSTRACT

A gerotor pump of n and n+1 type has the annulus and rotor located in a chamber with one wall provided by a floating coverplate held in place by a spring so that in the event of excess internal pressure the cover can lift to allow cross leakage between the inlet and outlet sides of the pump. FIG. 2 illustrates a typical embodiment.

2 Claims, 7 Drawing Figures

GEROTOR PUMP

This is a continuation of application Ser. No. 452,247, filed Dec. 22, 1982, now abandoned.

This invention relates to oil pumps of the kind comprising a rotor meshed in an eccentrically mounted annulus. An object of the invention is to provide a new and particularly compact construction which is versatile in its adaptability to different requirements, thus enabling manufacture of common components in substantial quantities to suit many different demands.

In accordance with the invention an oil pump of the kind referred to has a rotor having n lobes and annulus having n+1 lobes, rotatable in a chamber defined by a peripheral wall on a body formed with inlet and transfer passages, and said chamber being completed by a floating cover plate spring urged into position, and with drive to the rotor by a coupling extending through the plate, discharge of pump driven oil being transferred via the rotor centre for flow through the rotor and plate.

This construction, per se, gives a short axial length which is useful in itself: in addition, because it is of the n and n+1 type it enables a reversing ring to be disposed about the annulus to give automatic reversing (that is to enable the pump to operate in either direction of rotation); moreover it simplifies assembly.

The body can be located in appropriate flow connection to another part, so that flow from the outlet may effectively pressurise the end plate, and the construction may be such that in appropriate conditions when the pressure on opposite sides of said plate is unbalanced, the plate may float away from the rotor and allow cross leakage from inlet to outlet thus bypassing the pump members per se.

Embodiments of the invention are now more particularly described with reference to the accompanying drawings wherein.

Figure 1:
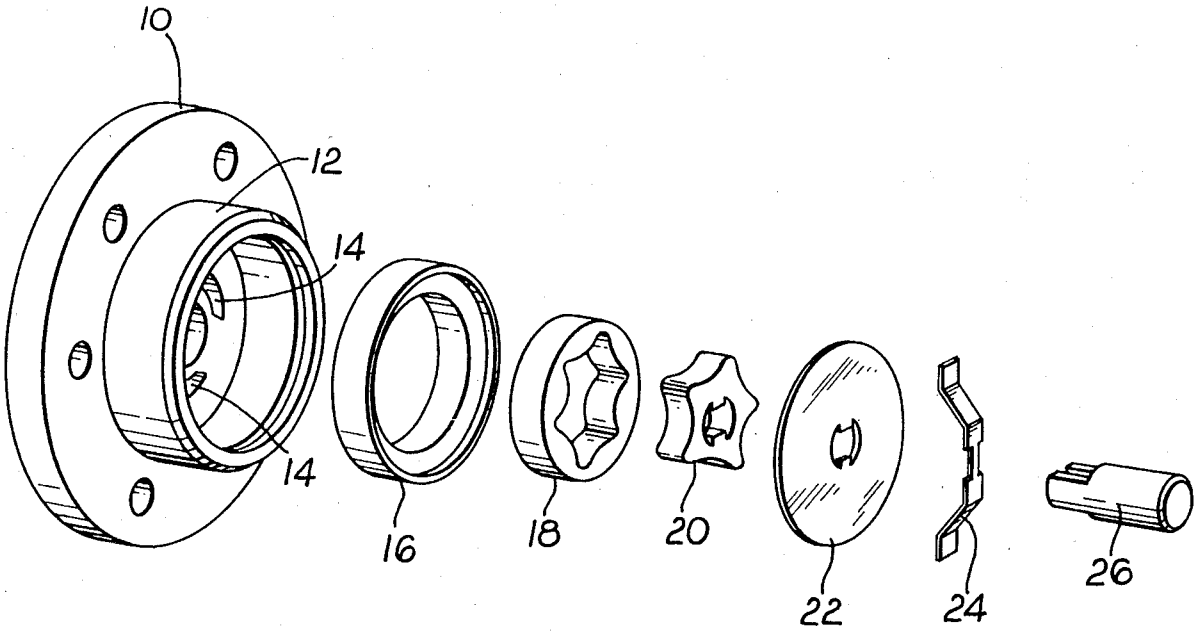
FIG. 1 is an exploded perspective view showing the components of a reversible gerotor pump.

Referring first to FIG. 1, the pump comprises a body 10 having a peripheral wall 12 forming a pump chamber, and with inlet and transfer ports 14 in the base of the same, the upper port (as seen in FIG. 1) being the inlet and the lower port being the transfer port. The body 10 is adapted to be secured to a member (not shown in FIG. 1) having a cavity therein into which the wall 12 and the gear-set fit so that there is a gap between end plate 22 and the base of the cavity.

A reversing ring 16 fits within the body, and is arranged to turn against a stop (not shown in FIG. 1) in either direction of rotation of the pump annulus 18 eccentrically mounted within the ring and in turning changes the direction of eccentricity of the annulus axis relative to the rotor 20 axis through 180°, in known manner. As illustrated the annulus has six lobes and the rotor 20 which fits in the annulus has five lobes but variations in the lobe numbers are possible.

The plate is held in place by spring 24, and the rotor is driven by the shaft 26.

There are various possibilities for using these components. In one such possibility the shaft not only drives the rotor but also the plate 22 and the spring 24, and effectively all four components 20, 22, 24, 26 turn as one. To this end the centre of the plate is arranged to key to the shaft, and the spring extends diametrically of the shaft between a pair of bifurcations on the same. The centre of the spring abuts the shaft between the bifurcations, and the extremities of the blade spring abut the plate 22. In this case the spring may be a light one designed to hold the plate in axial position so that the pump will prime and oil will flow out via the plates centre and act on the plate to hold it in sealing condition to the chamber. No pressure relief is provided, or if it is, it may be for example by way of a spring-loaded ball valve which, when lifted, enables oil to flow from the transfer port to exhaust.

Figure 2:
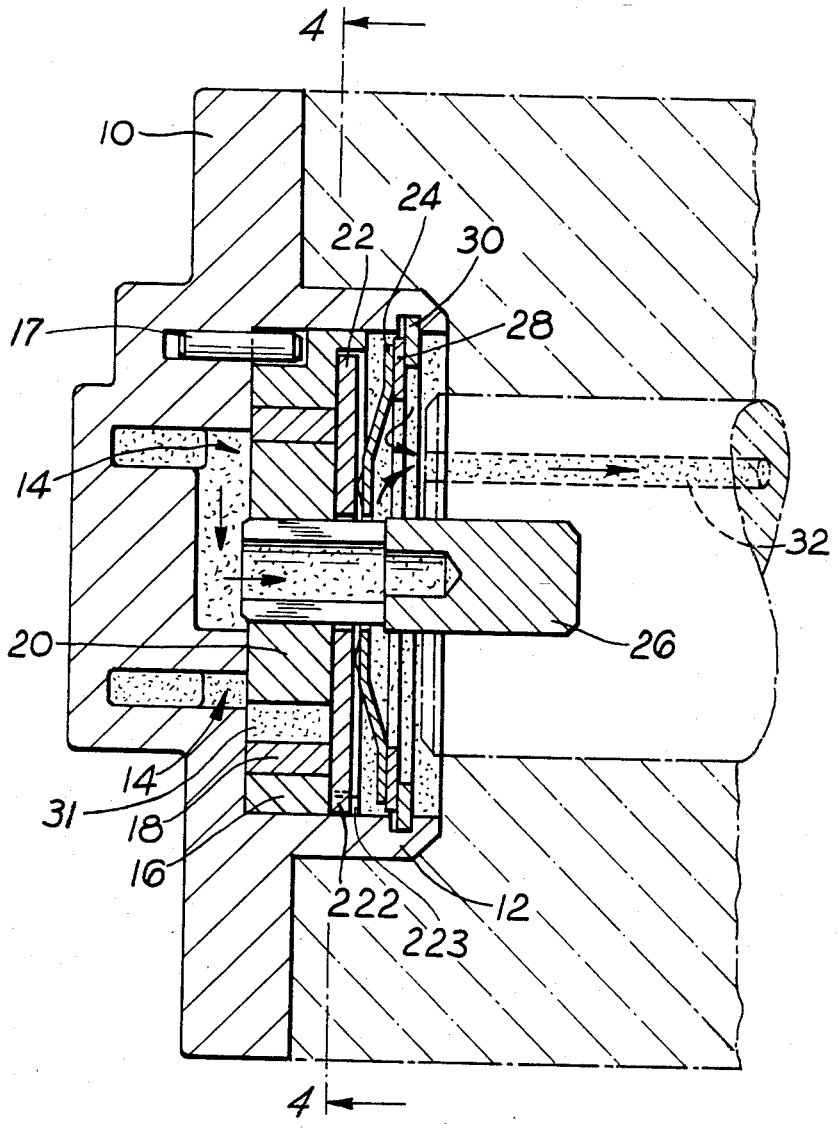
FIG. 2 is a part sectional view showing a pump.

Turning now to FIG. 2, this shows a similar set of components in assembled condition. The body 10 with the wall 12 and ports 14 and the rotors 18,20 may be identical to those in FIG. 1, but the plate 22 is provided with a peripheral lug 222 to key it to a slot 223 in the reversing ring 16, and in this case the centre of the plate 22 is made with a plain hole so that it is not keyed to the shaft. Similarly the spring, whilst being in the form of a blade spring or a plate spring having diametrically extending fingers, is not keyed to the shaft, and is arranged to abut the plate towards the centre of the same, and at its radially outer extremities seats on an annular washer 28 held in place axially by a circlip 30 engaged in a groove in the wall 12.

In this FIG. 2 arrangement, the shaft and rotor 20 turn as one, but in any one direction of rotation the spring plate and reversing ring remain stationary in one position. When the direction of rotation is changed, the rotors frictionally drag on the plate 22 and because of its keying to the reversing ring 16, this assists in turning the ring through 180 degrees (between stops 17).

As explained hereinbefore, such turning of the reversing ring 16 through 180 degrees changes the direction of eccentricity of the axis of the annular rotor 18 relative to the rotor 20 axis through 180°, thus changing the direction of pumping of the gerotor so that the port 14 which was the inlet remains the inlet when the direction of rotation is reversed.

In the FIG. 2 arrangement, a rather stronger spring is used than that in FIG. 1. As in any gerotor pump, pumping occurs in a direction opposite to the direction of eccentricity of the axis of the annularrotor 18 relative to the rotor 20 axis. Thus liquid flows from the adjacent (inlet) port 14 into the space 31 which is provided by the eccentricity of the annular rotor 18 relative to the inner rotor 20, and flows into the (upper) transfer port 14 and thence through the bifurcated shaft and via the axial passage 32.

Figure 3:
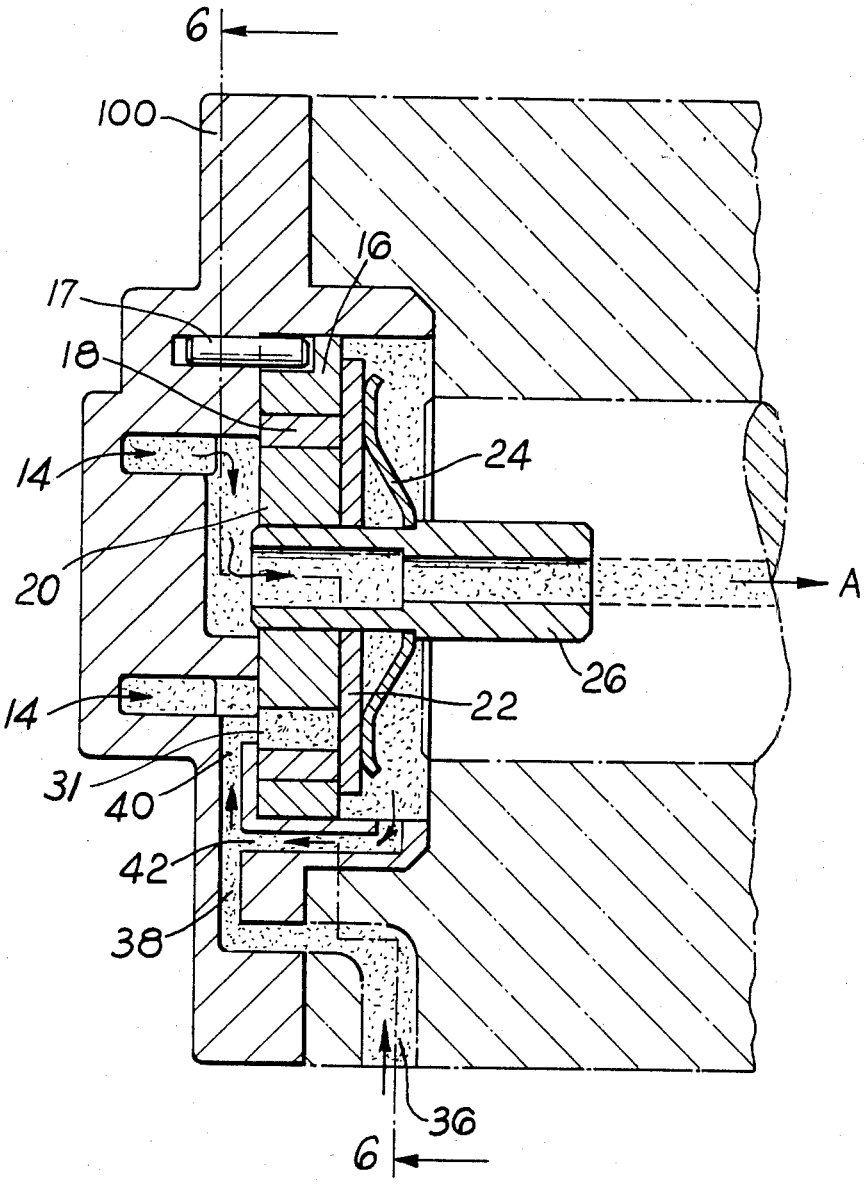
FIG. 3 is a view similar to FIG. 2 showing an alternative version.
Figure 4:
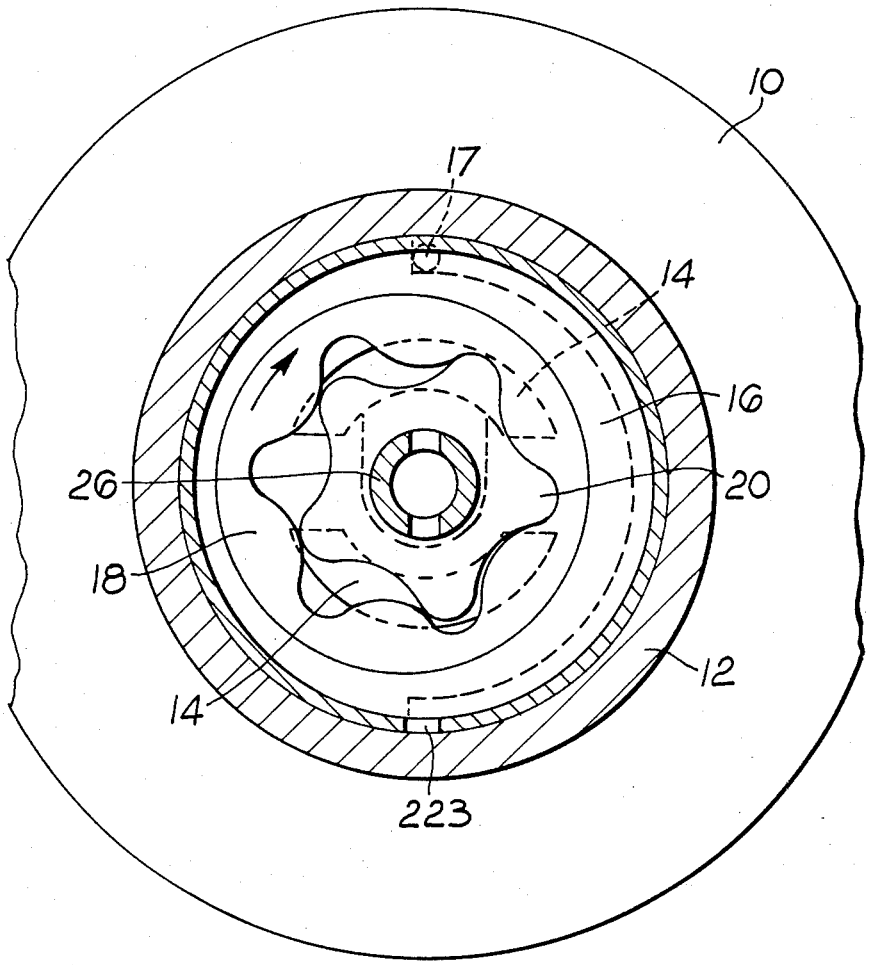
FIG. 4 is a section of the line 4—4 of FIG. 2 showing the orientation of the parts when the rotors are turning in the direction indicated by the arrow.
Figure 5:
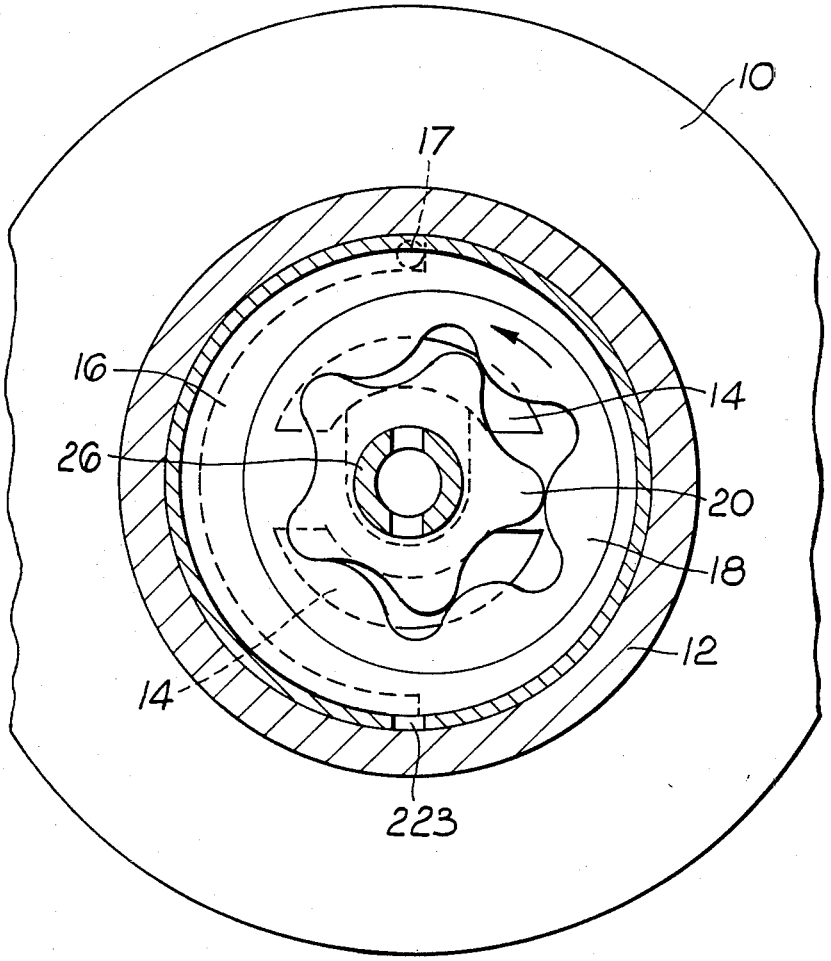
FIG. 5 is a section similar to FIG. 4, but showing the orientation of the parts when the rotors are turning in the opposite direction.
Figure 6:
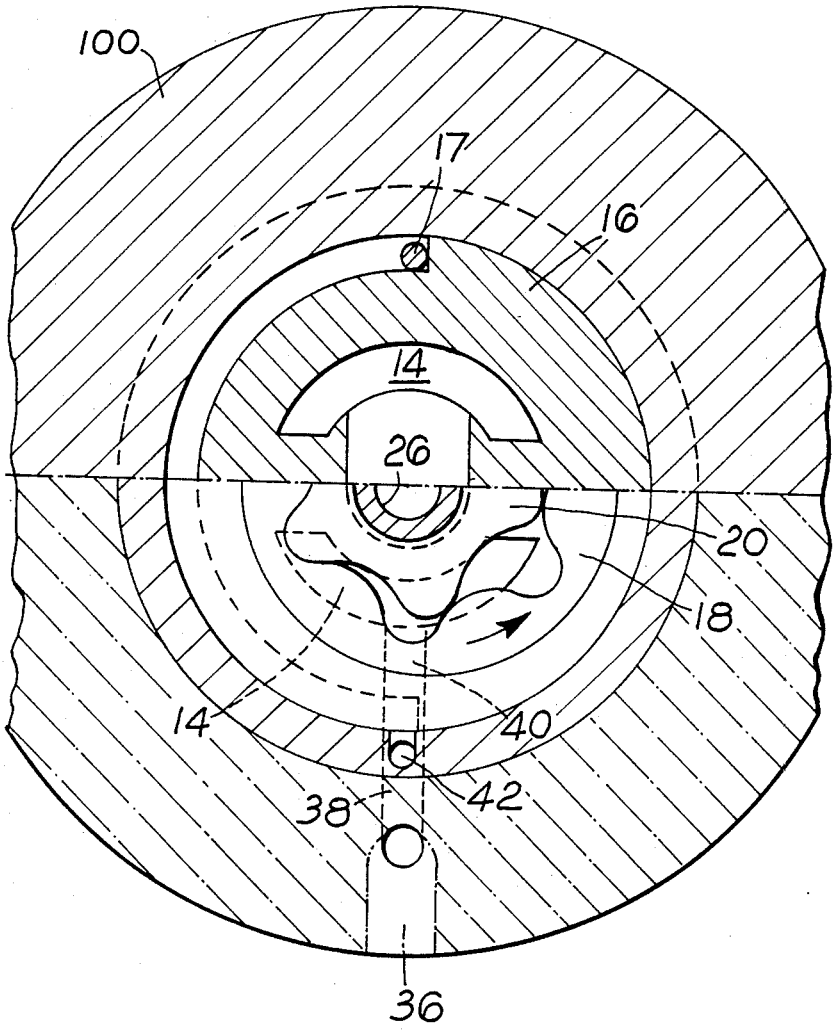
FIG. 6 is a section on the line 6—6 of FIG. 3.
Figure 7:
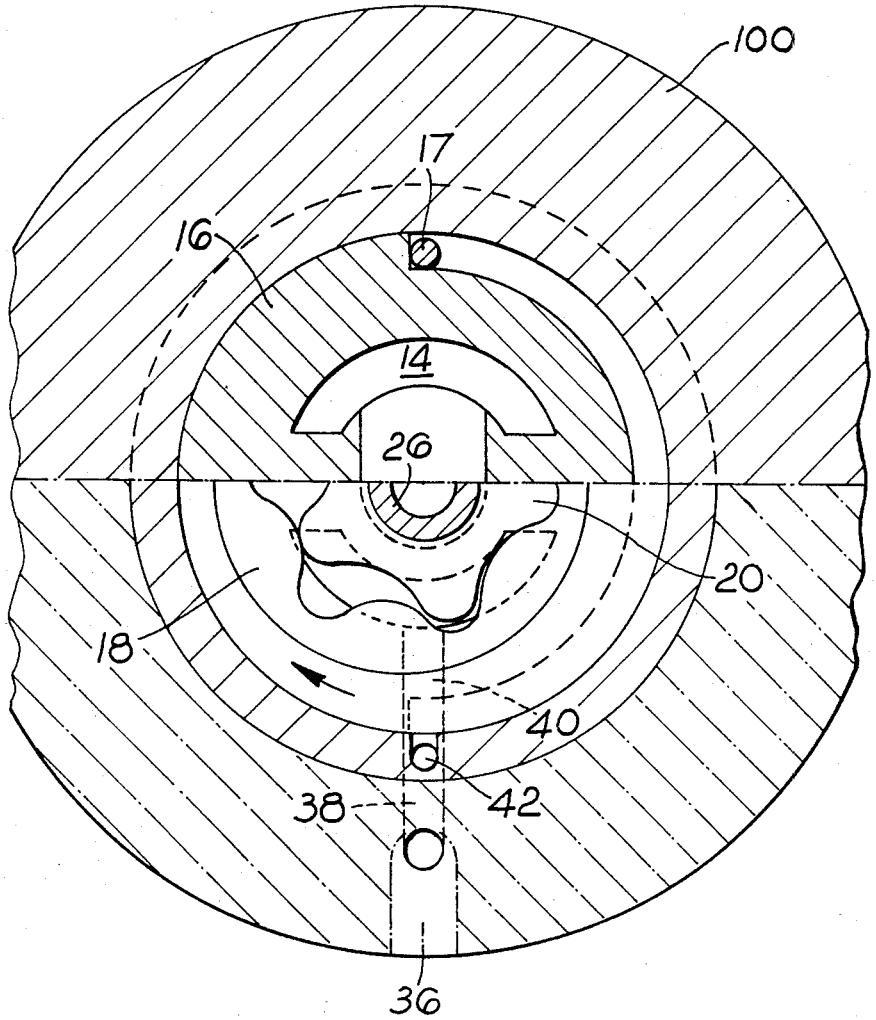
FIG. 7 is a section similar to FIG. 6, but showing the orientation of the parts with the direction of rotation of the rotors reversed.

Turning now to FIG. 3, the arrangement shown again uses components similar to those of FIG. 1, particularly in respect of the reversing ring 16 and the rotors 18,20. The shaft 26 is again keyed to the spring 24 and to the plate 22 so that all four components, that is including the rotor 20, rotate together. The reversing ring in this case is dragged from one position to the other in the event of reversal of direction of the shaft 26, solely by frictional drag between the adjacent cylindrical surfaces of the parts 16,18.

The FIG. 3 arrangement shows an inlet 36 for the oil and a passage system 38,40 in the body part 100 leading to the inlet port 14 and the space 31 between the rotors 18 and 20, and with connection 42 to relieve the pressure in the space in which the spring 24 is located. High pressure oil passes from the (upper) transfer port 14 through the shaft 26. In the event of internal pressure in the pump being such as to provide a displacing force on the plate 22 in the direction of the arrow A in the figure in excess of the force provided by the spring 24 in the opposite direction, the plate will float and allow leakage of fluid from the high pressure side of the pump to the low pressure side of the pump past the floating plate 22.

In the FIG. 3 example it is preferred to use a shaft which is not bifurcated, but has a non-circular end portion extending to a shoulder, with the shaft threaded through a complementary aperture in the spring and with the spring seated against that shoulder. This minimises the flow rate from the high pressure side of the pump to the space containing the spring, except when the plate 22 lifts against the spring.

In each of FIGS. 4, 5, 6 and 7, the space between the rotors 18 and 20 is expanding at the bottom and contracting at the top. This fluid is sucked from the lower port 14 and pumped into the upper port 14, in either direction of rotation of the rotors.

I claim:

1. A gerotor pump comprising a base having an integral circular wall projecting therefrom, a pair of ports in said base opening into a surface of the base within the wall, a ring rotatably mounted within the wall in contact with said surface, stops to limit rotation of said ring to 180°, an internally lobed rotor eccentrically journaled in said ring, a second, externally lobed rotor which is located within the first rotor and is fixed on a drive shaft concentrically with said ring, a plate which has an aperture through which the drive shaft extends to the second rotor, and which covers said rotors on the drive shaft side thereof, and a leaf spring which also has an aperture through which the drive shaft extends, and which bears against said plate to maintain the plate in sealing contact with said rotors against normal operating pressure, said plate being axially movable away from the rotors in the event of excess back pressure to provide a leakage path across the rotors.

2. A gerotor pump as claimed in claim 1 wherein the plate is keyed to the ring.

* * * * *